US005924152A

United States Patent [19]

Maier

[11] Patent Number: 5,924,152

[45] Date of Patent: Jul. 20, 1999

[54] DEVICE THAT CAN BE WALKED ON OR DRIVEN ON

[76] Inventor: Peter Maier, 78239 Rielasingen, Germany

[21] Appl. No.: 08/967,399

[22] Filed: Nov. 11, 1997

[51] Int. Cl.[6] ..... E01D 15/20

[52] U.S. Cl. ..... 14/2.4; 14/3; 14/6; 14/73

[58] Field of Search ..... 14/2.4, 3, 6, 73, 14/73.1; 404/47, 50, 51, 52, 53, 54

[56] References Cited

U.S. PATENT DOCUMENTS 4,285,514 8/1981 Romero ..... 272/3
5,519,909 5/1996 Fuessinger ..... 14/2.4
5,570,486 11/1996 Wiedeck ..... 14/13
5,651,154 7/1997 Ahlskog et al. ..... 14/6

*Primary Examiner*—Thomas B. Will
*Assistant Examiner*—Raymond W Addie
*Attorney, Agent, or Firm*—Bachman & LaPointe, P.C.

[57] ABSTRACT

In a device that can be walked on or driven on, for example for bridging under bridges requiring renovation or for bridging over streets, a web that can be walked on is connected to handrails via transverse struts. In this case, the web that can be walked on and/or the transverse struts and/or the handrails comprise extruded aluminum profiles.

21 Claims, 10 Drawing Sheets

3.1
2
V
V
1
3.2
4
5
6
7
3.1

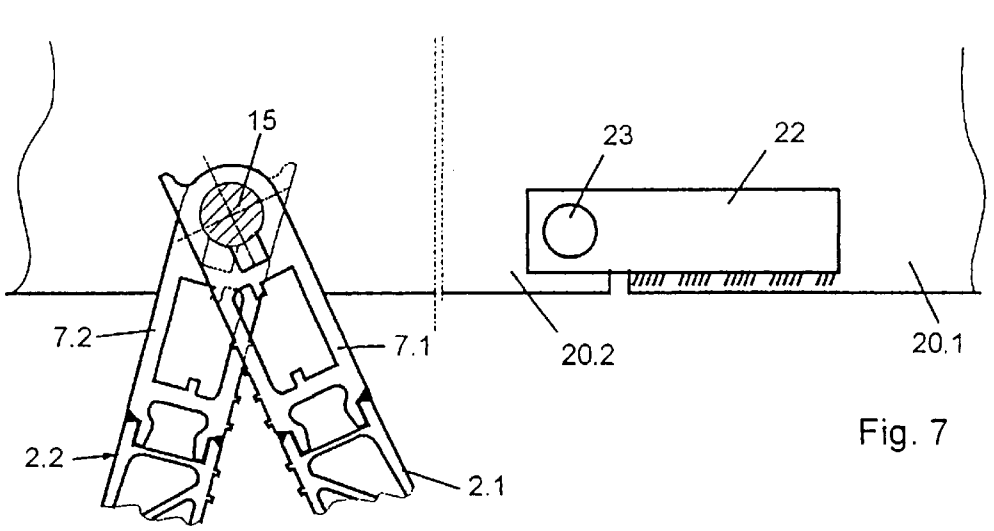
Fig. 7
Fig. 6
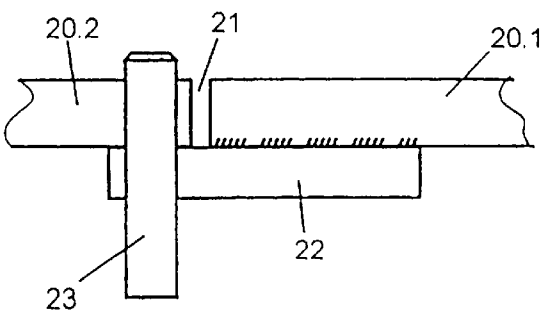
Fig. 8
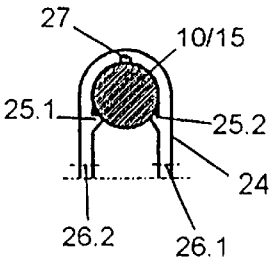
Fig. 11
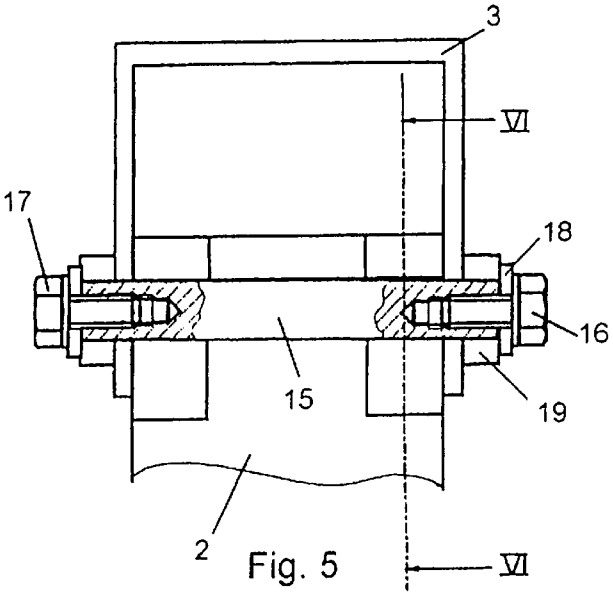
Fig. 5
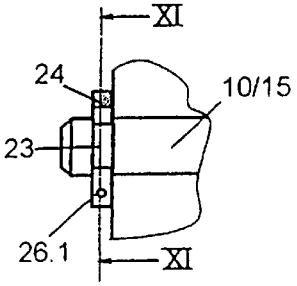
Fig. 10
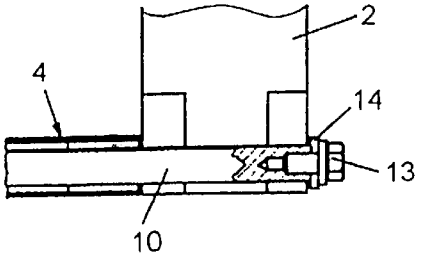
Fig. 9

DEVICE THAT CAN BE WALKED ON OR DRIVEN ON

BACKGROUND OF THE INVENTION

The invention relates to a device that can be walked on and/or driven on, for example for bridging under bridges requiring renovation or for bridging over streets, made of a web that can be walked on, which is connected to handrails via transverse struts.

In many applications nowadays, webs are needed which can be walked on by persons. Mention should be made here, only by way of example, of pedestrian crossways over streets, which are primarily erected to be removable once more when they are provided only in the short term. This often occurs in the case of building works on the actual pedestrian crossways or in the case of the re-equipment of subways.

Reference should be made, as a further example, to bridging under bridges requiring renovation, in which a web, which can be walked on by the appropriate workers, is led along under the bridge but is suspended at the top on the bridge. A means of bridging under in this way must not only be easy to put together but primarily also mobile, since this under-bridging means has to be displaced between two bridge pillars.

As mentioned above, these two examples are intended only to indicate the possible applications, and do not constitute any exhaustive enumeration. What is disadvantageous in the case of all these applications is that these devices that can be walked on and/or driven on are mostly produced from steel elements and are therefore very heavy. In addition, their assembly is extremely complicated and requires a great deal of time.

SUMMARY OF THE INVENTION

The present invention is based on the object of developing a device that can be walked on of the abovementioned type, which is relatively light in weight, easy to produce and very versatile.

The achievement of this object leads to the fact that the web that can be walked on and/or the transverse struts and/or the handrails comprises or comprise extruded aluminum profiles.

Extruded aluminum profiles have the advantage that they are significantly lighter in comparison with, for example, steel profiles. It is therefore possible, for example, to produce under-bridging means of considerable length without the weight being too high.

Furthermore, it is possible in the extrusion process to produce aluminum profiles in such a way that they have a very high stiffness. This means that such devices that can be walked on and/or driven on can be classified in terms of their safety exactly as highly as the devices made of steel.

A particular advantage of the use of extruded aluminum profiles resides in the fact that a device that can be walked on and driven on of this type may be produced in an extraordinarily versatile manner. It is possible to produce the device in any desired length and width, without complicated efforts having to be exerted in addition.

The appropriate aluminum profiles are laid together at their extruded length, joined together and connected to one another. It is then possible in each case to cut a series of boards or of transverse struts off from this structure made of a plurality of extruded aluminum profiles. It is also possible for sections of a desired length to be cut off from an extruded profile and joined to make the boards or used as transverse struts. This is an extremely cost-effective and rapid production process and allows the production of boards and transverse struts of any desired length and width.

It may be sufficient if the same structure made of appropriate extruded aluminum strips is used for boards and transverse struts, but in practice fewer aluminum profiles might be adequate for the transverse struts than for the boards. In any case, however, at least one profiled strip is provided, which is adjoined on both sides by hinge profiles. The hinge profiles have the function that an arbitrary number of boards and transverse struts can be coupled together, in order to produce a device that can be walked on in the desired length.

In a simple exemplary embodiment, the hinge profiles of adjacent boards or transverse struts are configured in such a way that they engage in each other like teeth. That is to say, fork-like lugs project from a board or from a transverse strut, between which in each case tongues from the other board or transverse strut are pushed. The connection is then preferably performed via appropriate transverse rods or transverse pins, which are pushed into the lugs or tongues through appropriate eyes. It is then only necessary to carry out securing of these transverse rods or transverse pins in order that they do not inadvertently slide out of the eyes.

In a simple exemplary embodiment, a securing of this type may comprise appropriate bolts. However, bolts have to be secured in turn, in order that they do not loosen inadvertently. For this reason, annular channels are preferably molded on a transverse rod or a transverse pin on both sides in each case, into which channels a clamping bracket similar to a snap ring is inserted. For example, this clamping bracket may have opposed latching knobs, so that the clamping bracket is, so to speak, clipped into the annular channel.

In a further, preferred exemplary embodiment, the boards and the transverse struts are configured in such a way that they can be exposed to considerable lateral loads. For this purpose it is necessary to support the transverse struts at the boards in a physically separated manner. Therefore, here the hinge profile of a board is enlarged, for example designed in a triangular shape. The articulation point of the transverse struts is then no longer located close to the walk-on plane of the boards but spatially separated therefrom. Provided above and beneath the articulation point are supporting strips or abutments, against which the ends of the transverse struts are pressed. The transverse struts are prevented from bending out by this means.

As mentioned above, the handrail also comprises an extruded aluminum profile. This may, for example, be a U-shaped profile, the handrail then being simply pushed over the ends of the transverse struts and likewise secured by means of the transverse pin.

In a particularly preferred exemplary embodiment, the handrail is also used for holding a facing, by means of which the spaces between the transverse struts are made safe. The facing may be, for example, a textile tarpaulin, which may also be printed. By this means, this facing may also serve at the same time to carry advertisements. The facing preferably has an edge trim, which can be pushed into an appropriate groove in the handrail. At the other end, the facing is then fixed via another fastening element, for example a piece of elastic or the like. The facing also offers a safeguard for the people who walk on the device.

Since the handrail is also intended to be produced from an extruded aluminum profile, this may comprise an outer tube from which two angle strips project on either side, onto which in turn the groove to accommodate the edge trim is integrally molded. In order to connect successive handrail sections, an inner tube is provided which is pushed into the outer tube. By means of appropriate transverse pins, successive handrails can be fixed via the inner tube.

In some cases there is also the desire to "house" a device that can be walked on and/or driven on. In the modular system, this can also be carried out with the proposed cutoff extruded profiles. The transverse pin, which secures the handrail with respect to the transverse struts, is extended, for example, so that further transverse struts can be pushed onto the extension, these further struts being directed upward. At the other end, these transverse struts are in turn connected by means of a corresponding handrail, a roofing sheet being laid over these opposite handrails.

In order to secure and to maintain a specific distance between these additional transverse struts, a transverse bar is provided, which connects the opposite transverse struts to each other and at the same time spaces them apart. Floorboards can also be laid onto the transverse bars, which possibly, if desired, can in turn be walked on.

The present invention produces a device that can be walked on and/or driven on which is very easy to erect and to remove once more, which can be varied arbitrarily in its length and which has a relatively low weight with adequate stiffness. The whole takes place in a modular system, a few profiles being sufficient to produce a bridge or the like of desired length.

BRIEF DESCRIPTION OF THE DRAWINGS

Further advantages, features and details of the invention emerge from the following description of preferred exemplary embodiments, and with reference to the drawing:

FIG. 5 shows a cross section, shown enlarged, through a part of the device that can be walked on according to FIG. 1, along the line V—V;

FIG. 6 shows a cross section through a part of FIG. 5 along the line VI—VI;

FIG. 7 shows a side view of a further region of the handrail according to FIG. 1;

FIG. 8 shows a plan view of the region of the handrail according to FIG. 7;

FIG. 9 shows a detail, broken open and partially in cross section, from the device that can be walked on according to FIG. 1 in the region of the connection of transverse struts to a web;

FIG. 10 shows a detail, shown enlarged, of a further exemplary embodiment of a possible connection between the individual elements of the device that can be walked on according to FIG. 1;

FIG. 11 shows a cross section through FIG. 10 along the line XI—XI;

FIG. 12 shows a side view of a board according to the invention for a further exemplary embodiment of a device that can be walked on;

FIG. 17 shows a perspective view of a subregion of a device that can be walked on;

DETAILED DESCRIPTION

Figures 1, 2:
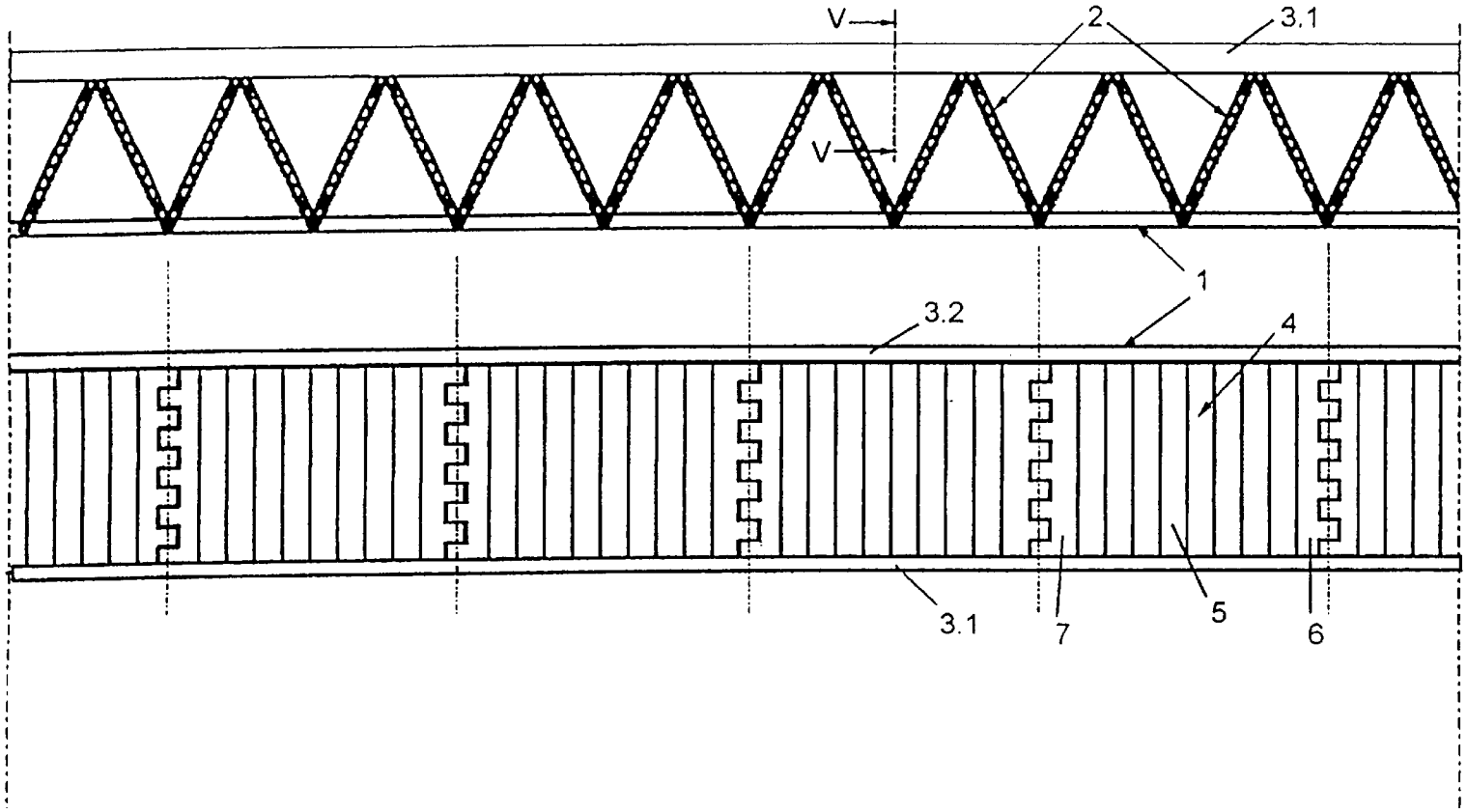
FIG. 1 shows a side view of a device that can be walked on according to the invention.
FIG. 2 shows a plan view of the device according to FIG. 1.
Figure 3:
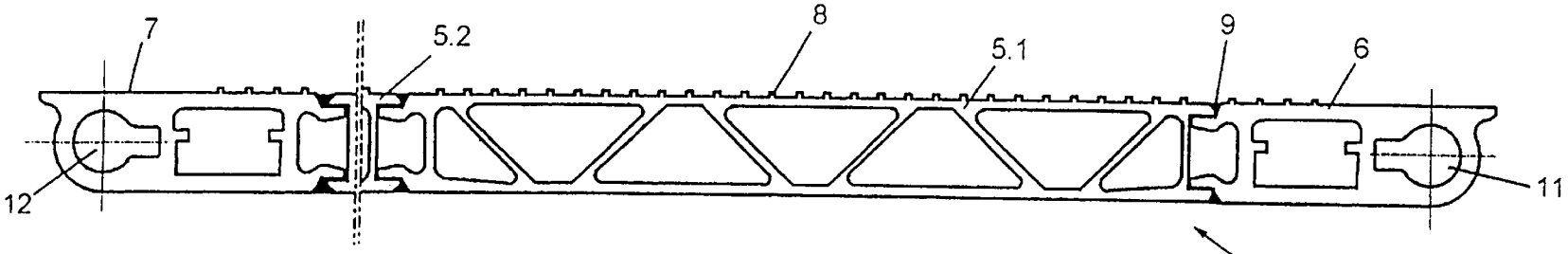
FIG. 3 shows a side view, shown enlarged, of a transverse strut according to the invention.
Figure 4:
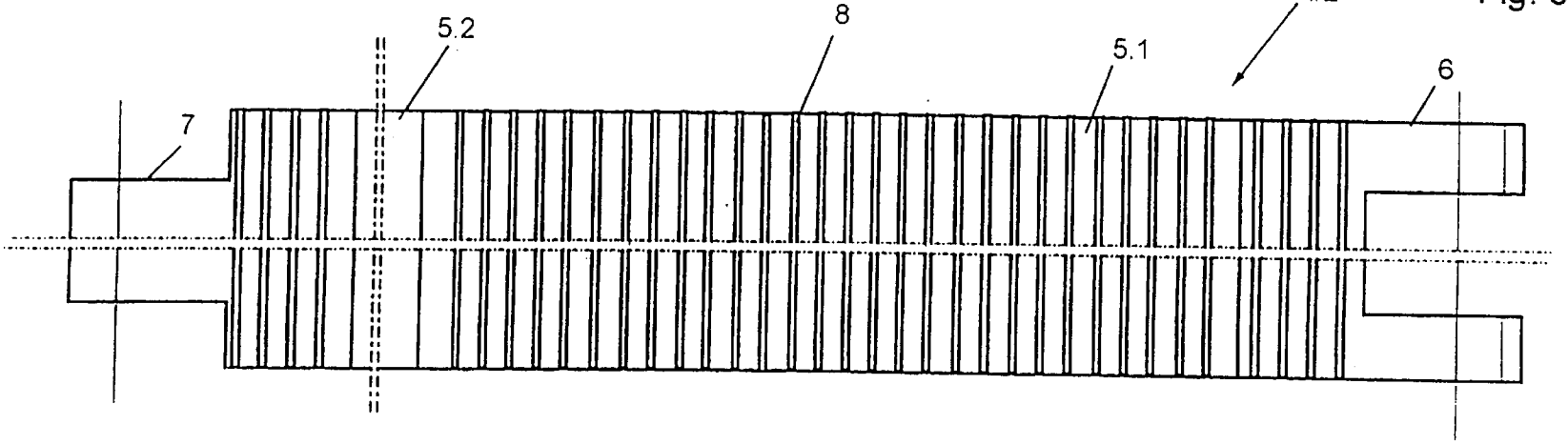
FIG. 4 shows a plan view of the transverse strut according to FIG. 3.

According to FIG. 1, a device that can be walked on according to the invention has a web 1, which is connected to handrails 3.1 and 3.2 on both sides via transverse struts 2. In this case, the web comprises individual boards 4, which are connected to one another in the manner of a hinge. In this way, a web 1 of any desired length can be produced. Each board 4 in turn comprises a plurality of profiled strips 5, which are produced from aluminum in the extrusion process. By way of example, it is indicated in FIGS. 3 and 4 how boards 4 of this type made of profiled strips 5 may be composed. In this case, however, it is also indicated at the same time in FIGS. 3 and 4 that the transverse struts 2 can be produced in the same way.

It can be seen that each board 4 and/or each transverse strut 2 begins with a hinge profile 6 and ends with a hinge profile 7. Between these there are various profiled strips 5.1 and 5.2, which may be of any desired configuration. Preference is given to a sandwich-like structure, which gives the overall board 4 and/or the transverse strut 2 an adequate stiffness. On the surface of the profiled strips 5 and the hinge profiles 6 and 7 there are ribs 8, which increase the resistance to slipping. The individual profiled strips 5 are connected to one another and to the hinge profile 6 or 7 by appropriate welded seams 9.

It can be seen in FIG. 2 that the hinge profiles 6 and 7 are configured in such a way that successive hinge profiles 6 and 7 engage in one another like teeth. The connection is then carried out by means of a transverse rod 10, illustrated in FIG. 9, which is pushed through appropriate eyes 11 and 12 in the hinge profiles 6 and 7. The securing of the transverse rod 10 on each side can be carried out by means of a bolt 13 screwed in at the end, with the interposition of an appropriate washer 14. Another possibility is described further below.

As mentioned above, the transverse struts 2 are also intended to be composed of individual profiles 5, the upper hinge profiles 7.1 and 7.2 of two cooperating transverse struts 2.1 and 2.2 being able to be seen in FIG. 6. The opposite hinge profile of each transverse strut 2.1 or 2.2 is connected in an articulated manner to the transverse rod 10, as indicated in FIG. 9.

The connection of the two cooperating transverse struts 2.1 and 2.2 together and to the handrail 3 is performed in accordance with FIG. 5 via a further transverse pin 15, into which on both sides bolts 16 and 17 are screwed at the ends, with the interposition of washers 18 and clamping pieces 19. By this means, an articulated fastening of the transverse struts 2 is performed, but the zig-zag arrangement imparts considerable stability to the overall device that can be walked on.

It can be seen in FIGS. 7 and 8 that the handrail 3 is also composed of individual sections 20.1 and 20.2. In this case, a joint 21 remains open between the sections 20.1 and 20.2, and is bridged over by a strip 22, which is only fixed on one section 20.1 by, for example, welding. The connection to the other section 20.2 is performed via a push-in pin 23, which secures the two sections 20.1 and 20.2 in relation to each other.

Instead of bolts 13, 16 or 17, another, easily detachable fixing of the corresponding transverse rods 10 or transverse pins 15 may be carried out, as is indicated in FIGS. 10 and 11. For this purpose, annular channels 23 are turned at the ends into the transverse rod 10 or transverse pin 15, into which channels snap-ring-like clamping brackets 24 can be inserted. Each clamping bracket 24 is shaped like a horse-shoe or U-shaped and has inwardly directed latching knobs 25.1 and 25.2, which engage behind the transverse rod 10 or the transverse pin 15. By this means, the fixing of the transverse rod 10 or the transverse pin 15 in the clamping bracket 24 is secured. Additional securing may further be performed, for example, by means of a cotter pin, bolt or else by a simple piece of wire, which is threaded through two opposite drilled holes 26.1 and 26.2 in the clamping bracket 24, the two ends of the piece of wire being twisted together. In order that the clamping bracket 24 may be pushed more easily over the transverse rod 10 or the transverse pin 15 in the region of the annular channel 23, that is to say that the clamping bracket 24 opens more easily, a slight weakening 27 is provided in its vertex area.

The production of the device that can be walked on according to the invention takes place as follows:

Using the extrusion process, profiled strips 5 and hinge profiles 6 and 7 are produced. In order to form the boards 4, a number of profiled strips 5 are connected to one another by welding, any arbitrary amount of intermeshing between the individual profiled strips being able to take place here, such as for example tongue and groove connections or the like. However, the connection is as a rule always performed via a welded seam. However, the invention is not restricted to this; provided it is suitable, the connection may also be performed via a mechanical or chemical bonding means.

The hinge profiles are incised like teeth, so that a good tooth-like or hinge-like connection between the individual boards can take place at a later time.

Since as a rule the extruded profiles have a considerable length, this process also produces a structure which is significantly longer than the width of a desired board. However, this means that a plurality of boards can be cut off from such a structure.

Provided the boards 4 have a length which corresponds to that of the transverse strut 2, it is now possible for a plurality of transverse struts 2 to be cut off from a board 4, like wafers, in the longitudinal direction. When doing this, care should be taken that here, too, the opposite hinge moldings alternate, as is clarified in FIG. 4 and also in FIG. 2.

As a rule, however, the boards should have a greater length than the transverse struts 2. For this reason, it proves to be advisable to produce the transverse struts 2 from a number of dedicated profiled strips or hinge profiles. Production takes place in the same way as the production of the boards 4, but using a reduced number of profiled strips.

Depending on the desired length of the web 1, boards are now connected to one another, in each case a hinge profile 6 cooperating with a hinge profile 7 of the following board. After this, the transverse rod 10 is pushed through the eyes 11 and 12. On both sides, a transverse strut 2 is pushed onto each transverse rod 10 and secured by means of the bolt 13 and/or the clamping bracket 24.

At the other end, the transverse strut 2 is fixed on the handrail 3, a connection here of two adjacent transverse struts 2.1 and 2.2 being performed by means of the transverse pin 15 and the corresponding bolts 16, 17 and/or the clamping bracket 24.

As a rule, further transverse struts might be necessary between two board ends in each case, as can be seen in FIG. 1. The fixing of these transverse struts to the web 1 can be performed either via a short pin or via a further transverse rod, which is pushed through the sandwich-like structure of the profiled strips 5 and shows out of the profiled strips 5 on both sides. Two ends of adjacent transverse struts, which in turn engage in each other like teeth, can also be pushed onto this transverse rod. Securing is carried out once more via a bolt or the abovementioned clamping bracket 24.

Figure 12:
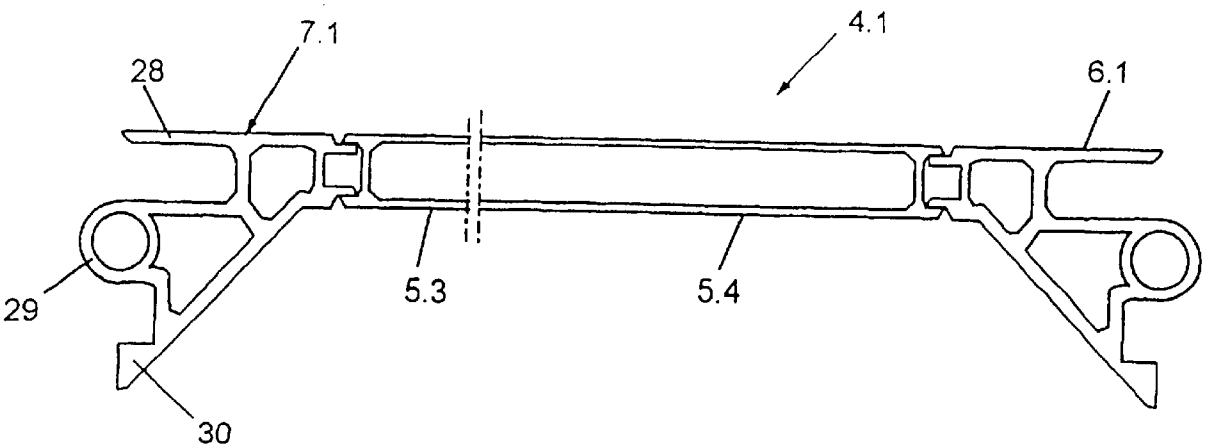

Shown in FIG. 12 is a further exemplary embodiment of a board 4.1. Like the board 4, the board 4.1 is also produced from a plurality of profiled strips 5.3 and 5.4. These profiled strips 5 are preferably produced from aluminum in the extrusion process, appropriate strips of the desired width being cut off from this extruded profile.

Figure 13:
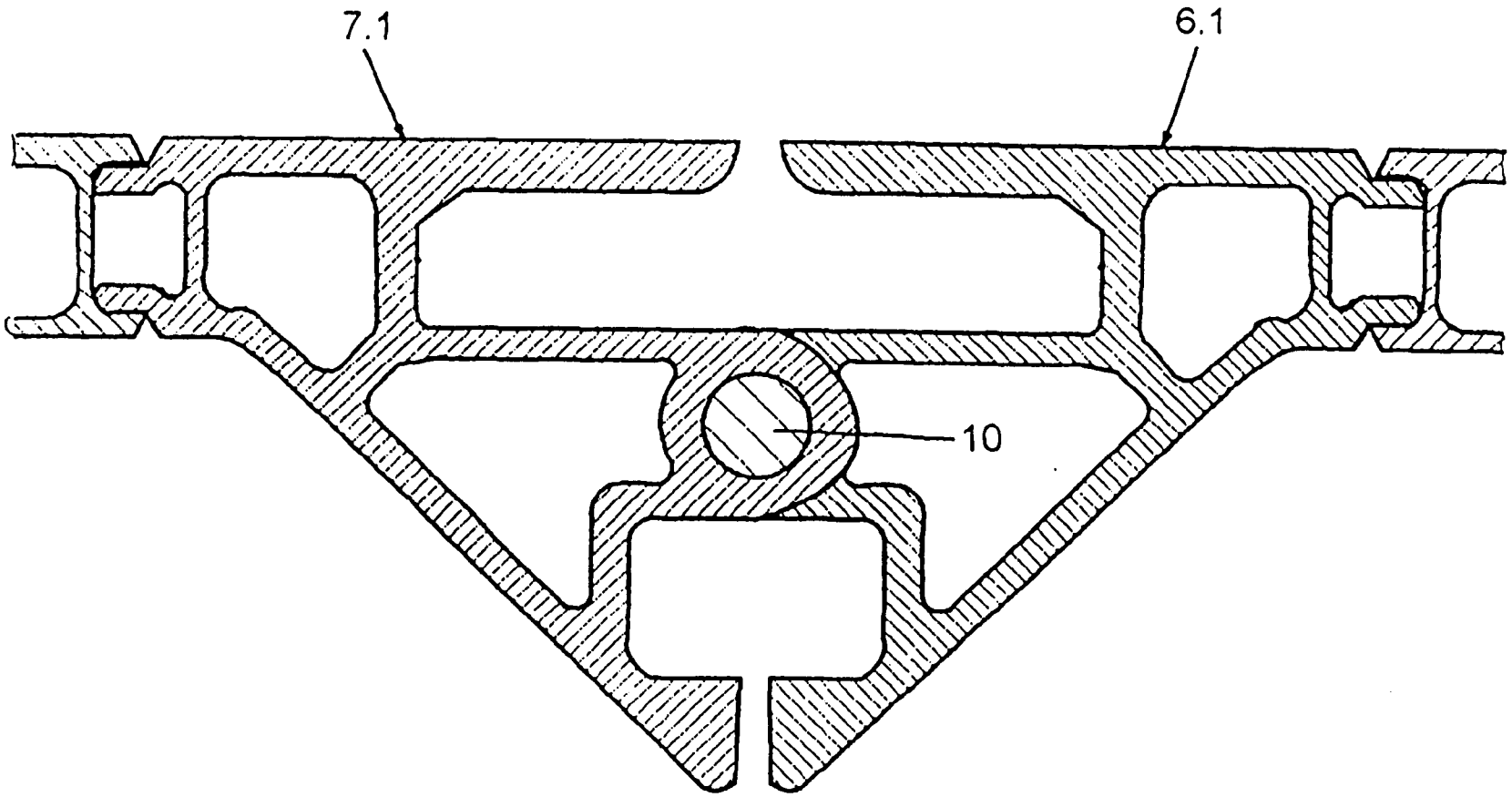
FIG. 13 shows a cross section through a part of the device that can be walked on in the region of the connecting point of two boards according to FIG. 12.
Figure 16:
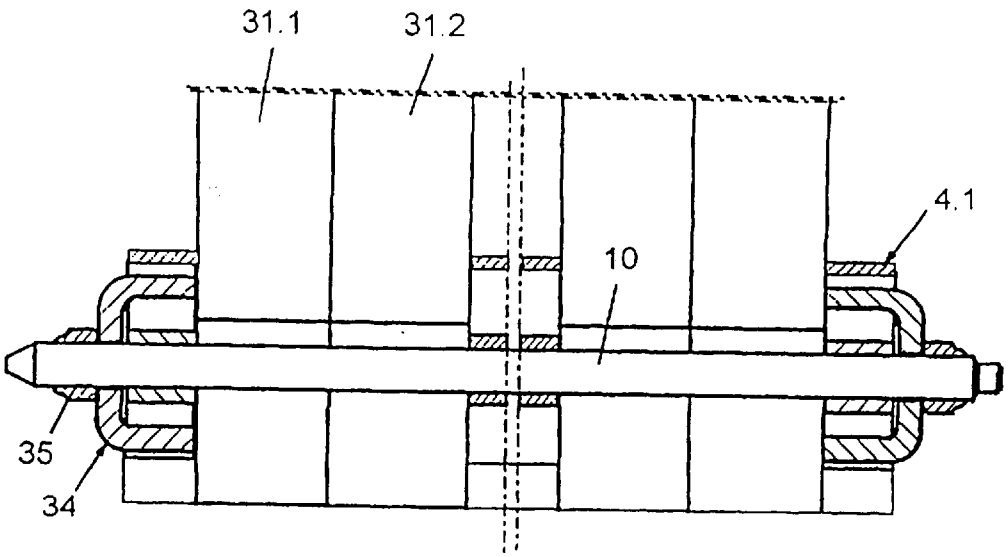
FIG. 16 shows a cross section through the connecting point of the boards according to FIG. 15 with inserted transverse struts.
Figure 15:
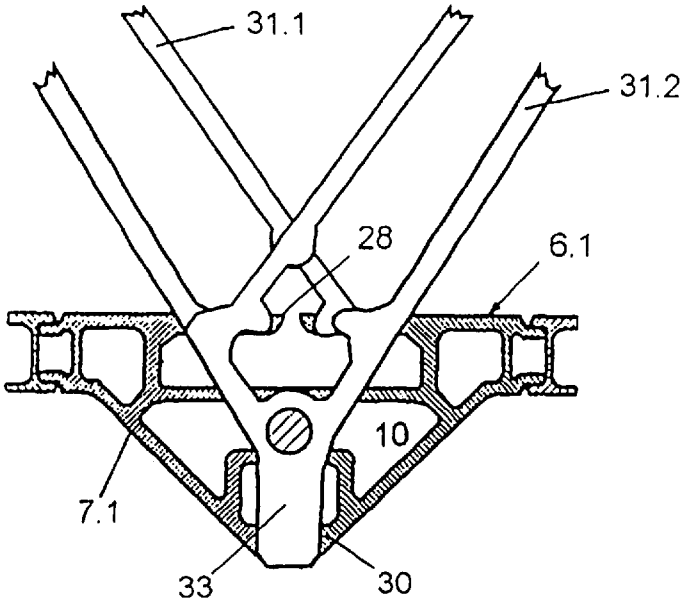
FIG. 15 shows a detail from a connecting region of two boards similar to FIG. 13, with fixed transverse struts.
Figure 17:
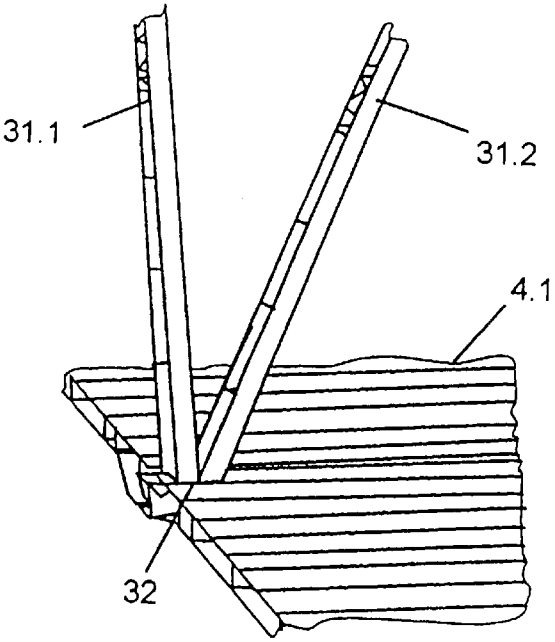

Whereas the profiled strips 5.4 are designed as simple box profiles, the hinge profiles 6.1 and 7.1 have a dedicated shape, which primarily serves the strength or the lateral load bearing ability of the board 4.1. The hinge profiles 6.1 and 7.1 are overall approximately triangular-shaped in their contour, there being provided in the plane that can be walked on of the board 4 a supporting strip 28, below this supporting strip 28 a sleeve section 29, and below the latter an abutment 30. In this case, the sleeve sections 29 project approximately half way beyond the supporting strips 28 and the abutment 30, each hinge profile 6.1 and 7.1 being provided with a plurality of sleeve sections 29 arranged in an offset manner, which when the boards 4.1 are placed together with further boards 4.1, cooperate like teeth with sleeve sections arranged there. This is indicated in FIG. 13, the transverse rod 10 being pushed through the sleeve sections 29 in order to connect a hinge profile 6.1 to a hinge profile 7.1 of the adjacent board. In the region of the connection to transverse struts 31.1 and 31.2, the hinge profiles 6.1 and 7.1 have an incision 32, into which the transverse struts 31.1 and 31.2 can be inserted, as is illustrated in FIGS. 15 and 17. The transverse struts 31.1 and 31.2 are then likewise passed through by the transverse rod 10 and thus connected to the boards 4.1.

The advantage of arranging the transverse rod 10 deeper underneath the walk-on level of the board 4.1 and of the triangular configuration of the hinge profiles 6.1 and 7.1 with the supporting strips 28 and abutment 30 resides in the fact that the corresponding ends of the transverse struts 31.1 and 31.2 can be supported against these supporting strips 28 and abutment 30, which can then intercept the appropriate forces in the event of lateral loading of the transverse struts 31.1 and 31.2. The bending out of the transverse struts 31 is effectively prevented by this means.

Figure 14:
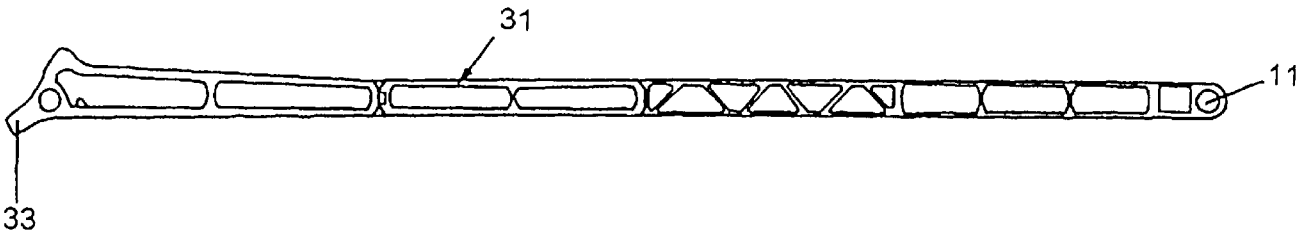
FIG. 14 shows a plan view of a further exemplary embodiment of a transverse strut.

In order that the transverse struts 31.1 and 31.2 can cooperate with the abutments 30, as is indicated in FIG. 15, the corresponding transverse strut 31.1 or 31.2 in each case has an integrally-molded supporting lug 33, which presses onto the abutment 30. A corresponding transverse strut 31 of this type is shown in FIG. 14.

In order that the transverse struts 31.1 and 31.2 can also have an appropriately distributed pressure applied to them from the outside, the transverse rod 10 has pushed onto it a U-shaped clamp 34, which presses onto the transverse struts 31.1 and 31.2 with its limbs remote from the transverse rod 10. A nut 35 is provided for fixing the clamp 34.

Figure 18:
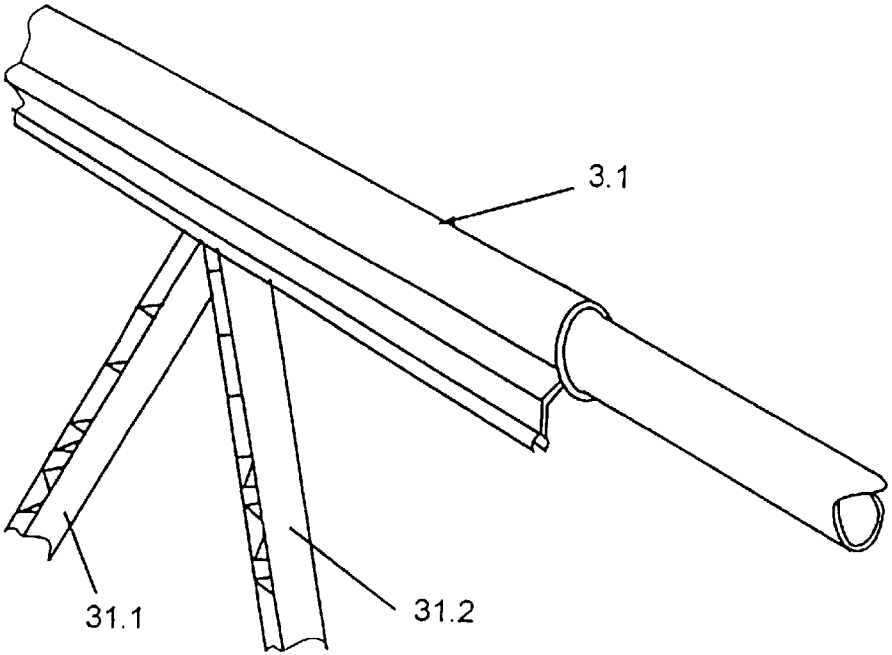
FIG. 18 shows a perspective view of a further exemplary embodiment of a handrail on transverse struts.
Figure 19:
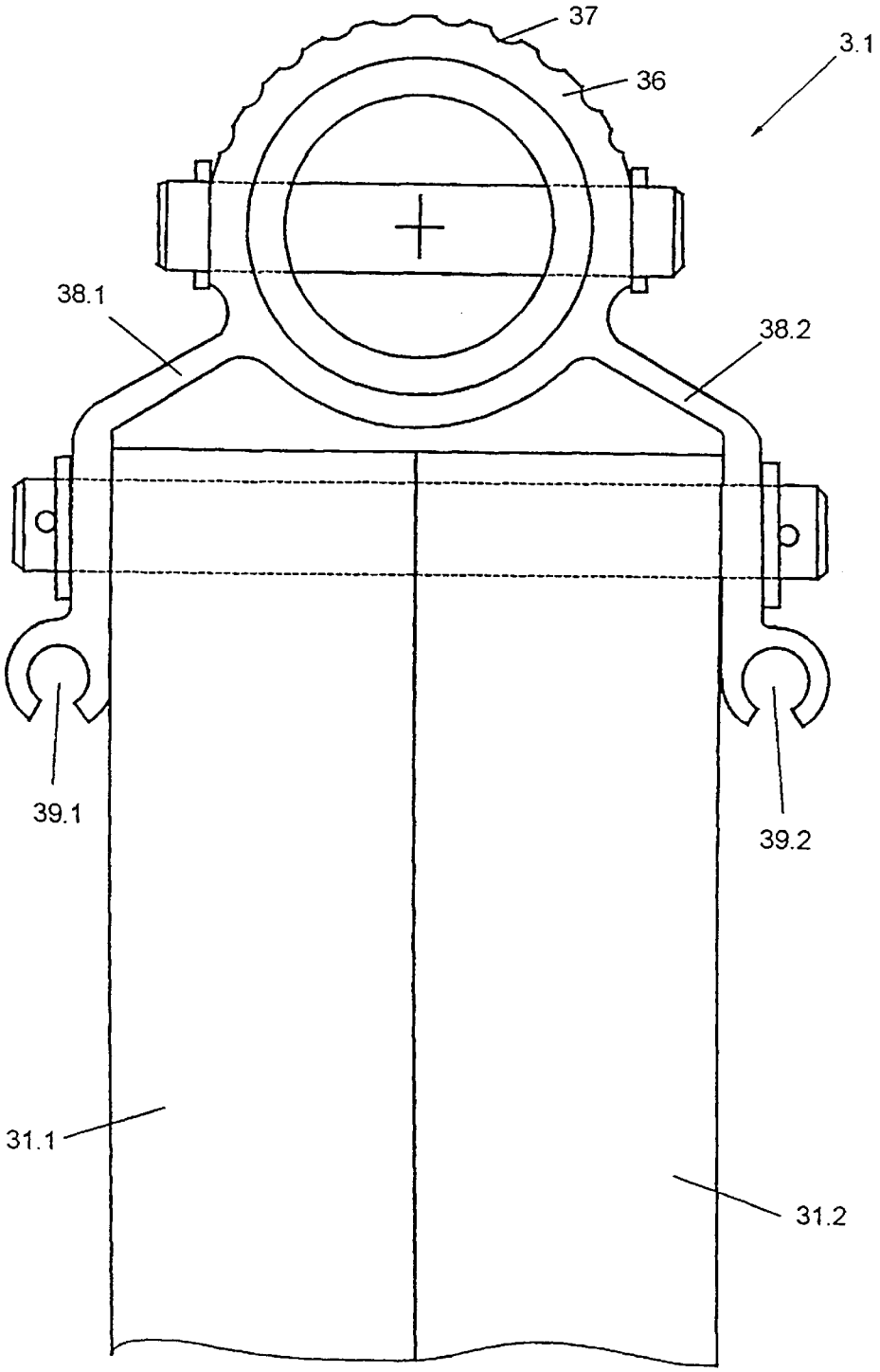
FIG. 19 shows a side view of a connecting point with a further exemplary embodiment of a handrail according to the invention on transverse struts.

FIGS. 18 and 19 primarily show a further exemplary embodiment of a handrail 3.1. The latter likewise comprises preferably extruded aluminum profiled sections, an outer tube 36 being provided which has grooving 37 on its surface. This grooving 37 improves the possible grip.

Spaced angle strips 38.1 and 38.2 project from the outer tube 36, and in the position of use engage over the transverse struts 31.1 and 31.2. Integrally molded in each case at the end of each angle strip 38.1 and 38.2 is a groove 39.1 and 39.2, which serves to accommodate an edge trim 40, as is described in relation to FIG. 20.

A connection of the handrail 3.1 to the two transverse struts 31.1 and 31.2 is performed via a transverse pin 15.1, which is secured by cotter pins 41.

Successive handrail sections 3.1 are preferably connected to one another by an inner tube 42, which is pushed into adjacent ends of outer tubes 36. Here, too, securing of the inner tube 42 is performed via a securing pin 43, which is secured by a cotter pin.

Figure 20:
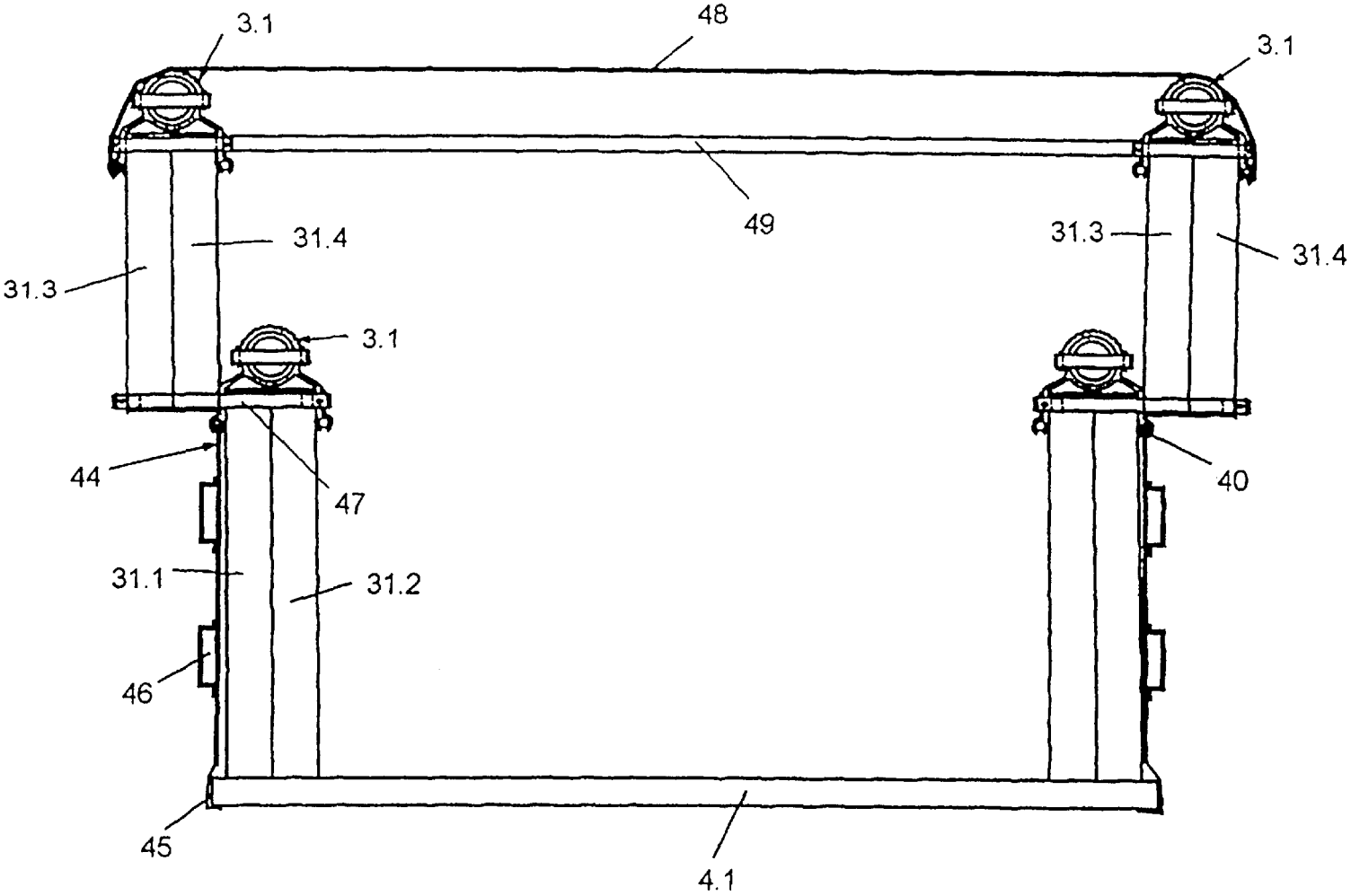
FIG. 20 shows a schematic illustration of a further exemplary embodiment of a device that can be walked on according to the invention.

Illustrated in FIG. 20 is a device that can be walked on which is "housed". It is possible to see boards 4.1, from which transverse struts 31.1 and 31.2 project. The handrail 3.1 is fitted on these transverse struts 31.1 and 31.2. Cladding the areas between the transverse struts is performed by a facing 44. The facing 44 preferably comprises a suitable textile material which has the edge trim 40 at the edge. This edge trim 40 is pushed into a groove 39 in the handrail 3.1. The lower end of the facing 44 is fixed in any desired manner. For example, a piece of elastic 45 is conceivable, which engages via an appropriate hook into corresponding holes in the underside of the board 4.1. However, other possibilities are also conceivable here.

In order to stiffen the facing 44, pockets 46 are further provided, into which it is possible to push reinforcing strips, not shown in more detail.

For the purpose of housing, the transverse pin 15.1 is replaced by a transverse rod 47, which projects somewhat beyond the transverse strut 31.1. Further transverse struts 31.3 and 31.4 are pushed onto this transverse rod 47 and fastened by means of cotter pins or the like. Fitted onto these transverse struts 31.3 and 31.4 is a further handrail 3.1, on which a roofing sheet 48 rests firmly. This roofing sheet 48 extends from the handrail 3.1 to the opposite handrail 3.1 and is fastened there in any desired way. This preferably takes place there once more via a piece of elastic or the like, not shown in more detail.

In order to improve the stability and, in particular, to secure the spacing, there is provided between the opposite transverse struts 31.3/31.4 a transverse bar 49, which simultaneously also replaces the transverse pin 15.1 connecting the handrail 3.1 to the transverse struts 31.3/31.4.

Figure 21:
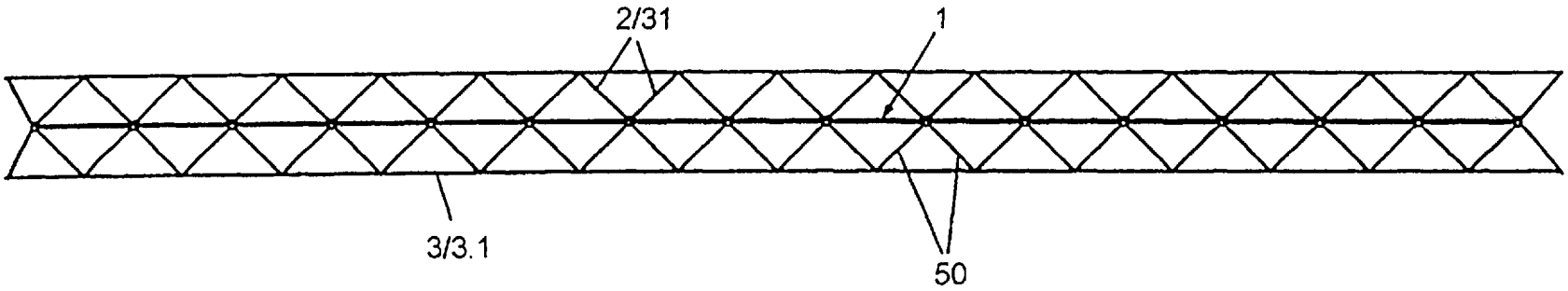
FIG. 21 shows a schematic illustration of a further exemplary embodiment of a device that can be walked on, corresponding to FIG. 1.

FIG. 21 indicates that it is also possible for downwardly projecting lower struts 50 to be provided. The connecting of these lower struts 50 to the boards 4 or 4.1 is performed via the transverse rods 10. At the other end, the lower struts 50 can be connected to one another by handrail elements 3/3.1. This mirror-image arrangement in relation to the transverse struts 3/31 gives the overall device enormous strength and is primarily suitable for relatively long bridges.

It is inherently self-evident that hinge profiles 6/7 at the beginning of a web 1 may be replaced by an appropriate drive-on profile, which is of wedge-shaped design. In this way, a bridge of this type may also be suitable for vehicles.

I claim:

1. A bridge desk system comprising:

a web extending along a longitudinal axis, said web comprising a plurality of boards, each board having at least three aluminum profiles extending transverse to said longitudinal axis including two end profiles and at least one intermediate aluminum profile, each end profile being provided with hinge means for hingedly connecting said plurality of boards together along said longitudinal axis to form said web having two side edges extending substantially parallel to said longitudinal axis;

a pair of aluminum rails disposed above said web, said rails being spaced from and substantially parallel to one another and to said longitudinal axis; and a plurality of aluminum struts arranged between and directly connected to said web and said rails for supporting said rails above said web.

2. The device as claimed in claim 1, wherein the at least one intermediate profile strip and hinge end profiles are connected to one another by welded seams.

3. The device as claimed in claim 1, wherein the hinge and profiles of adjacent boards included projections and recesses which interlock such that the projection on one board is received in the recess of an adjacent board for forming said hinge means.

4. The device as claimed in claim 3, wherein the projections are provided with transverse passages receiving a transverse rod for connecting said adjacent hinge end profiles.

5. The device as claimed in claim 1, wherein the hinge end profiles are triangular in shape and comprises a supporting strip, a sleeve section below said supporting strip and an abutment portion below said sleeve section.

6. The device as claimed in claim 5, wherein the sleeve section projects beyond the supporting strip and the abutment.

7. The device as claimed in claim 6, wherein a supporting lug is integrally molded on each of the struts.

8. The device as claimed in claim 5, wherein a transverse rod is pushed through adjacent sleeve sections, on which clamps for fixing the struts are pushed.

9. The device as claimed in claim 8, wherein the transverse rod is secured on both sides by bolts.

10. The device as claimed in claim 5, wherein an annular channel is molded in the transverse rod and a clamping bracket is inserted into said channel.

11. The device as claimed in claim 10, wherein the clamping bracket is of U-shaped design and has latching knobs.

12. The device as claimed in claim 11, wherein the clamping bracket has drilled holes to accommodate a fastening means.

13. The device as claimed in claim 1, wherein said rails are of U-shaped design and rests firmly on the struts.

14. The device as claimed in claim 1, wherein said rails comprise an outer tube from which two angle strips project.

15. The device as claimed in claim 14, wherein a groove is integrally molded on at an end of each of the angle strips.

16. The device as claimed in claim 15, wherein an edge trim of a facing can be inserted into the groove.

17. The device as claimed in claim 16, wherein an inner tube is received in the outer tube.

18. The device as claimed in claim 16, wherein the facing has pockets to accommodate stiffening profiles.

19. The device as claimed in claim 1, wherein struts have connected to them further struts having handrails for holding a roofing sheet.

20. The device as claimed in claim 19, wherein the further struts are connected to one another via transverse bars.

21. The device as claimed in claim 1, wherein the struts project downward from the web.

* * * * *